United States Patent [19]

Mitchell

[11] 4,424,113

[45] Jan. 3, 1984

[54] PROCESSING OF TAR SANDS

[75] Inventor: Thomas O. Mitchell, Trenton, N.J.

[73] Assignee: Mobil Oil Corporation, New York, N.Y.

[21] Appl. No.: 511,615

[22] Filed: Jul. 7, 1983

[51] Int. Cl.[3] ..... C10G 1/04

[52] U.S. Cl. ..... 208/11 LE; 208/8 LE

[58] Field of Search ..... 208/11 LE, 8 LE, 11 R, 208/8 R

[56] References Cited

U.S. PATENT DOCUMENTS

| | | | |
|---|---|---|---|
| 2,911,349 | 11/1959 | Coulson | 208/11 R |
| 2,980,600 | 4/1961 | Kelley | 208/11 LE |
| 3,530,042 | 9/1970 | Graybill et al. | 208/11 LE |
| 3,594,306 | 7/1971 | Dobson | 208/11 LE |
| 3,850,738 | 11/1974 | Stewart et al. | 208/11 LE |
| 4,005,005 | 1/1977 | McCollum et al. | 208/11 LE |
| 4,036,732 | 7/1977 | Irani et al. | 208/11 LE |
| 4,094,767 | 6/1978 | Gifford | 208/11 LE |
| 4,098,674 | 7/1978 | Rammler et al. | 208/11 LE |

*Primary Examiner*—Delbert E. Gantz
*Assistant Examiner*—A. Pal
*Attorney, Agent, or Firm*—Alexander J. McKillop; James F. Powers, Jr.; Lawrence O. Miller

[57] ABSTRACT

The present invention relates to an improved process for the recovery of bitumen from tar sands comprising first heating the raw tar sands with steam at a temperature sufficient to visbreak a portion of the bitumen without significant thermal cracking thereby producing a vaporous distillate product mixed with steam and lowering the viscosity and specific gravity of the residual bitumen on the heat treated tar sands. The distillate product and steam are cooled and condensed and mixed with the heat treated tar sands containing residual beneficiated bitumen to form a slurry. Bitumen is then recovered from the slurry by a hot-water separation process.

19 Claims, 1 Drawing Figure

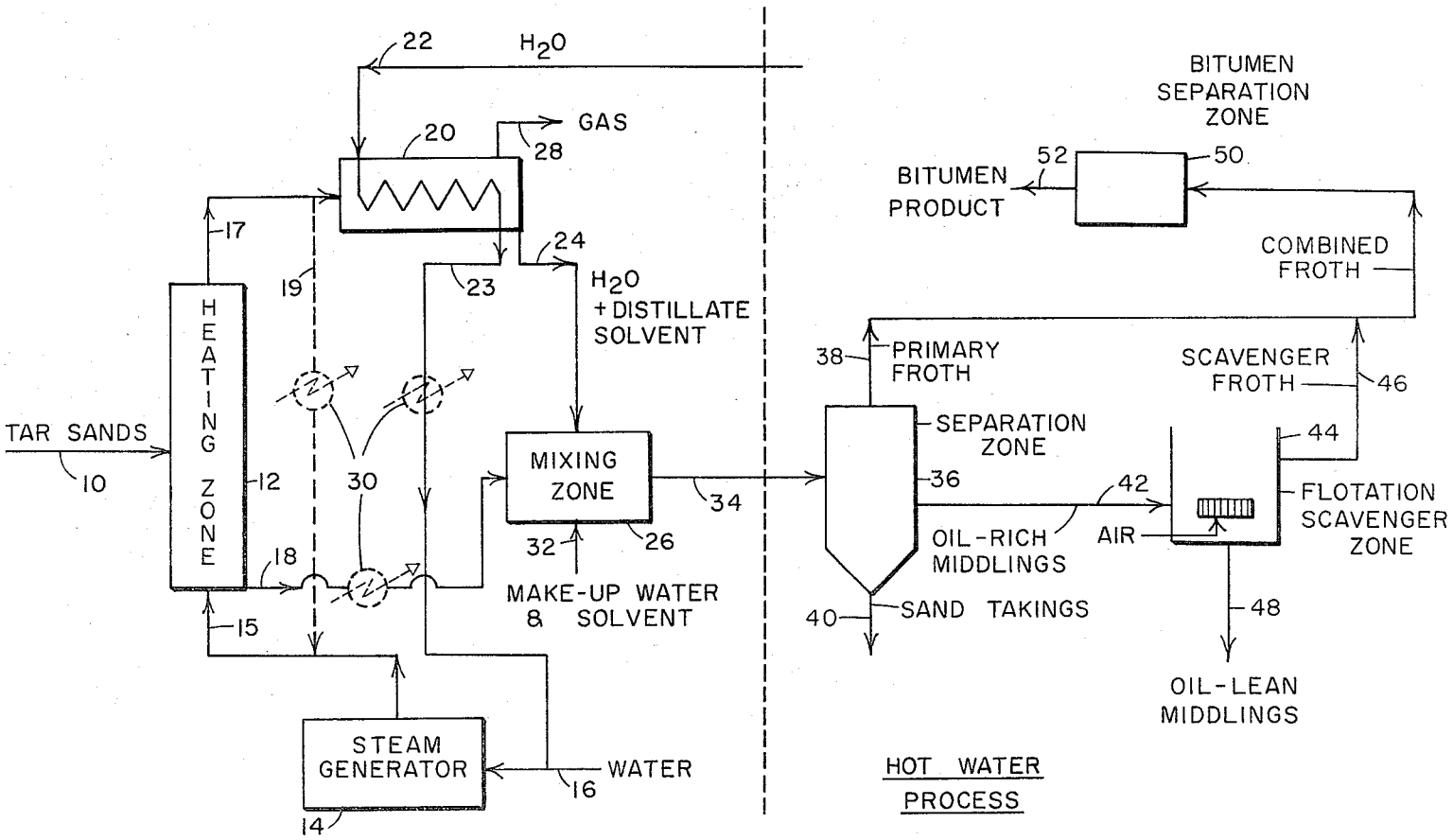
BITUMEN SEPARATION ZONE
50
COMBINED FROTH
46
SCAVENGER FROTH
44
FLOTATION SCAVENGER ZONE
48
OIL-LEAN MIDDLINGS
52
BITUMEN PRODUCT
42
AIR
PRIMARY FROTH
SEPARATION ZONE
36
OIL-RICH MIDDLINGS
SAND TAKINGS
38
40
HOT WATER PROCESS
34
H2O
GAS
28
24
H2O + DISTILLATE SOLVENT
MIXING ZONE
26
MAKE-UP WATER & SOLVENT
32
WATER
16
22
20
23
30
STEAM GENERATOR
14
19
18
12
17
15
HEATING ZONE
TAR SANDS
10

PROCESSING OF TAR SANDS

FIELD AND BACKGROUND OF THE INVENTION

1. Field of the Invention

This invention relates to a method for recovering bitumen from tar sand and, more particularly, to a combination process embodying the technique of heating the raw tar sands sufficiently to produce a distillate solvent and lowering the viscosity and specific gravity of the residual bitumen and employing the distillate as a solvent to aid in the recovery of residual bitumen from the heat treated tar sands using a hot-water separation system.

2. Background of the Invention

Tar sands, also known as oil sands and bituminous sands, are siliceous materials impregnated with petroliferous material convertible to petroleum products. The largest and most important deposits of the sands are the Athabasca sands found in northern Alberta, Canada. These sands underlay more than 13,000 square miles at a depth of 0 to 2,000 feet. The tar sands are primarily silica, closely associated with pertroliferous material (heavy oil material) which varies from about 5 to 21 percent by weight, with a typical content of 13 weight percent comprising the sand. The oil is quite heavy, 6° to 8° API gravity and contains typically 4.5 percent sulfur and about 38 percent aromatics. The sands include clay and silt in quantities of from 1 to 50 weight percent (more usually 10 to 30 percent) and water in quantities of 1 to 10 percent by weight. The recovery of oily product from the tar sand has been pursued by a "cold water process", a "hot water process" as well as by retort methods which are akin to thermal cracking or pyrolysis techniques as used to process oil shale. A thermal method of recovering bitumen by direct retorting has been studied since 1940. In direct retorting, the raw oil sand is contacted with spent sand and fluidized by reactor off gas at a temperature above 900° F. The volatile products are flashed while 2 to 7 weight percent of coke (based on sand) is deposited via thermal cracking. The coked sand is burned off in a separate unit at 1200° to 1400° F. and recirculated. The voluminous amount of spent sand needed, i.e., 5 to 10 parts per part of cold tar sand, for the process necessitates a very large retort volume per barrel of recoverable oil. Such methods obviously are expensive and of little interest. Serious waste heat and handling problems arise with this process.

In the hot water method, recovery of bitumen from the tar sands consist of "digesting" a hot water/raw bitumen sand mixture to cause physical disengagement of bitumen from the sand; flotation to produce a bitumen/water overhead, clean sand bottoms, and a middlings fraction containing bitumen, sand fines (often clays), and water; further separation of bitumen from the middlings: and coking of the bitumen to produce a useful liquid product. The biggest problem with Canadian tar sands is the high fines content that results in a large middlings fraction and ultimately a water/fines byproduct from which the fines will not settle; this requires large slimes ponds (not now allowed in Canada) and high water consumption. The biggest problem with Utah tar sands is the high bitumen viscosity and specific gravity resulting in difficult disengagement and flotation. Solvent, usually a recycled naphtha, can be added to reduce bitumen viscosity and specific gravity, but this adds to the complexity and solvent loss is an expensive problem. Finally, bitumen coking is expensive and reduces useful product yield.

The present invention is concerned with a combination process which involves first heating the raw incoming tar sands at a temperature sufficient to distill and visbreak a portion of the bitumen to produce a distillate and lowering the residual bitumen viscosity and specific gravity. The distillate fraction is used as a solvent to aid in the recovery of bitumen from the heat treated tar sands by a hot water separation system.

SUMMARY OF THE INVENTION

The present invention is concerned with a process for treating tar sands. More particularly, the present invention is a process for recovering bitumen from bituminous tar sands comprising heating the tar sands with steam in a heating zone under conditions sufficient to partially visbreak the bituminous material thereby producing a vaporous hydrocarbon distillate mixed with steam and leaving a substantial amount of residual bituminous material of reduced viscosity and specific gravity on the heat treated tar sands. The heating zone is operated at temperatures within the range of 500° F. to 850° F. and pressures of 50 to 1500 psig depending upon the bituminous content of the particular sand charged. Substantially all of the vaporous mixture of hydrocarbon distillate and steam is recovered, cooled and condensed. The waste heat set free during cooling and condensation of the vaporous distillate and steam can be utilized for generating hot water that can be used in the generation of steam used in heating the tar sands. The tar sands containing beneficiated residual bituminous material are mixed with the condensed mixture of hydrocarbon distillate and water to form a slurry wherein the distillate acts as a solvent for the bituminous material in the tar sands. Bitumen is then removed from the slurry by a hot-water separation process.

BRIEF DESCRIPTION OF THE DRAWING

The drawing is a schematic showing of a preferred embodiment of the novel process of this invention wherein the left half illustrates the heat treatment section and the right half the hot water separation process.

DESCRIPTION OF THE PREFERRED EMBODIMENTS

This invention relates to a method for the processing of tar sands. Referring to the accompanying drawing which is a schematic flow sheet, tar sands comprising petroliferous material in the range of about 5 to 21 weight percent and more usually less than 15 percent by weight are fed, with or without connnate water, in line 10, to a heating zone 12, where they are heated to a temperature within the range of 500° to 850° F. depending upon the bituminous content of the particular sand charged. Tar sands fed through line 10 may be preheated provided that any vapors formed are passed into heating zone 12 along with the heated tar sands. The pressure of heating zone 12 may be in the range of 50 to 1500 psig. In heating zone 12, the introduced tar sands are mixed with high temperature steam from steam generator 14 introduced into the lower portion of heating zone 12 via conduit 15. The amount of steam injected is within the range of 5 to 500 percent by weight of the hydrocarbon charged and solids retention time of 0.05 to 7 hours. The steam generated from generator 14 is at a high temperature of within the range of about 500° F. to 1250° F. and may be at a pressure of from 50 to 1500 psig. Steam generator 14 is supplied by boiler feed quality water via conduit 16. The high temperature steam has the effect of distilling and visbreaking a portion of the bitumen constituent of the tar sands without significant thermal cracking thereby producing a vaporized hydrocarbon distillate and lowering the viscosity and specific gravity of the residual bitumen. Substantially all of the vaporous product comprising distillate mixed with steam is recovered from the upper portion of the heating zone 12 by means of line 17. The amount of distillation and mild visbreaking can be controlled by the choice of steam temperature and residence time. The distillate recovered is a relatively light hydrocarbon material having an end boiling point within the range of 500° F. to about 800° F. The hot tar sand containing residual bituminous material reduced in viscosity and a portion, if any, of the distillate and steam are withdrawn from the bottom of heating zone 12 via line 18. Heating zone 12 may be an ebullated bed, a fluid bed, or conventional. A portion of the mixture of vaporized distillate and steam recovered via line 17 may be recycled to heating zone 12 via line 19 communicating between conduits 17 and 15. Heat balance and ebullition or fluidization if desired can be controlled by the relative amounts of distillate and steam recovered through line 17, recycled through line 19, or allowed to pass through line 18. The mixture of distillate vapor and steam not recycled to the heating zone 12 is passed by conduit 17 to indirect heat exchanger 20. In exchanger 20, the hot gaseous mixture indirectly preheats water charged thereto by conduit 22 that is recovered from the exchanger via conduit 23. The preheated water is passed to steam generator 14 via line 23 and 16 for use as a make-up boiler feed water. Condensed hydrocarbon distillate and water is recovered from exchanger 20 by conduit 24 and passed to a mixing zone 26 where it is thoroughly mixed with the hot tar sand withdrawn from heating zone 12 via conduit 18. Non-condensable gases are taken from the exchanger 20 via conduit 28. These gases can be used as fuel or can be disposed of in any other suitable manner. The steam generated by steam generator 14 may not provide all the heat necessary in heating zone 12. Additional heat may be recovered from indirect heat exchangers 30 located in lines 18, 19, and 23.

The condensed distillate mixed with the hot tar sands in zone 26 functions as a solvent to dissolve the residual bitumen constituent of the tar sands and reduce its viscosity. The proportion of tar sands, distillate solvent, and water in mixing zone 26 is preferably maintained at a ratio of about 35 to 65 weight percent tar sands, about 35 to 65 weight percent water, and about 5 to 15 weight percent distillate solvent which can be controlled by introducing make-up water and/or a solvent into mixing zone 26 via conduit 32. The make-up solvent can be any diluent which has the ability to dissolve the bitumen constituent of tar sand and to reduce its viscosity. Usually the boiling range of the solvent is between 250° F. to 800° F. Suitable solvents include petroleum fractions such as naptha, kerosene, gas oil distillates, furnace oils and aromatic hydrocarbons.

Mixing zone 26 is operated at approximately atmospheric pressure and a temperature within the range of 70° F. to 100° F., and preferably at about 80° F. to 85° F. After the solvent, water, and heat treated tar sands are thoroughly mixed in zone 26 the mixture in the form of a slurry is processed by a conventional hot water method to separate residual bitumen from the tar sands. In the embodiment illustrated in the drawing, the tar sand slurry is withdrawn from mixing zone 26 via line 34 and introduced to a separation zone 36 containing hot water. In the separation zone 36 the slurry forms into bitumen and solvent froth which rises to the cell top and is withdrawn via line 38 and a sand tailings layer which settles to the bottom and is withdrawn through line 40. The sand tailings contain little bitumen which reduces the environmental pollution problems associated with their disposal. An aqueous middlings layer forms between the froth and tailings layer and a portion of this layer is withdrawn through line 42 that contains some oil which did not separate. The oil-rich middlings are sent through line 42 to a scavenger zone 44 wherein an air flotation operation is conducted to cause the formation of additional bitumen froth which passes from the scavenger zone 44 through line 46 and thence to line 38 for further processing in admixture with the froth from the primary zone. An oil-lean middlings steam is removed and discarded from the bottom of the scavenger zone 44 via line 48.

The mixture of froths from the primary and scavenger zones is directed via line 38 to the bitumen separation zone 50 where the desired product bitumen is recovered and removed through line 52. Any process known in the art may be used here for separating bitumen from the froth. For example, U.S. Pat. Nos. 2,968,603 and 3,496,093 teach dilution and the application of centrifugal force in a single or plural stage to effect the separation.

It is recognized that a number of different known hot water methods for separating the bitumen from the heat treated tar sands may be substituted for the particular embodiment described above and it is intended that such variations may be a part of the combination above discussed without departing from the scope of the invention.

What is claimed is:

1. A process for recovering bitumen from bituminous tar sands comprising:

(a) heating the tar sands with steam in a heating zone under conditions sufficient to partially visbreak the bituminous material thereby producing a vaporous hydrocarbon distillate mixed with steam and leaving a substantial amount of residual bituminous material of reduced viscosity and specific gravity on said heat treated tar sands;

(b) recovering substantially all of the vaporous mixture of hydrocarbon distillate and steam and cooling and condensing the mixture;

(c) recovering the tar sand containing beneficiated residual bituminous material and mixing it with the condensed mixture of hydrocarbon distillate and water to form a slurry; and (d) recovering the bituminous material from the slurry by a hot-water separation process.

2. The process of claim 1 further comprising adding a predetermined amount of water to the mixture formed in step (c).

3. The process of claim 1 further comprising adding a predetermined amount of a solvent characterized by having a boiling range between about 300° F. to about 800° F. to the mixture formed in step (c).

4. The process of claim 1 wherein during step (a) the tar sands are heated with steam at a temperature within the range of 500° F. to 850° F. and a pressure with the range of 50 to 1500 psig.

5. The process of claim 4 wherein the amount of steam is about 5 to 500 percent by weight of the bituminous hydrocarbon charged with the tar sands.

6. The process of claim 1 wherein the hot vaporized mixture of distillate and steam recovered from the heating zone is used indirectly to preheat water for use in generating steam used in the heating zone.

7. The process of claim 1 wherein the mixture formed during step (c) contains about 35 to 65 percent by weight tar sands, about 35 to 65 percent by weight water, and about 5 to 15 percent by weight solvent and the mixing temperature is about 70° F. to about 100° F.

8. The process of claim 1 wherein the end boiling point of the hydrocarbon distillate recovered from the heating step (a) is within the range of about 500° F. to about 800° F.

9. The process of claim 1 wherein at least a part of the heat energy required for the heating zone is generated by heat exchange with hot sand particles or gaseous and vaporous distillate recovered from the heating zone.

10. A process for recovering bitumen from bituminous tar sand comprising:

(a) heating the tar sands with steam in a heating zone under conditions sufficient to partially visbreak the bituminous material thereby producing a vaporous hydrocarbon distillate mixed with steam and leaving a substantial amount of residual bituminous material of reduced viscosity and specific gravity on said heat treated tar sands;

(b) recovering substantially all of the vaporous mixture of hydrocarbon distillate and steam and cooling and condensing the mixture;

(c) recovering the tar sand containing beneficiated residual bituminous material and mixing it with the condensed mixture of hydrocarbon distillate and water to form a slurry;

(d) passing the mixture to a process separation zone to form an upper bitumen froth, a lower sand tailings layer and a middlings layer comprising water, mineral and bitumen; and (e) separately removing said bitumen froth layer and recovering bitumen therefrom.

11. The process of claim 10 which additionally comprises passing a portion of said middlings layer to a scavenger zone and therein recovering an additional amount of bitumen froth which is mixed with the separated upper bitumen froth.

12. The process of claim 10 further comprising adding a predetermined amount of water to the mixture formed in step (c).

13. The process of claim 10 further comprising adding a predetermined amount of a solvent chracterized by having a boiling range between about 300° F. to about 800° F. to the mixture formed in step (c).

14. The process of claim 10 wherein during step (a) the tar sands are heated with steam at a temperature within the range of 500° F. to 850° F. and a pressure with the range of about 50 to 1500 psig.

15. The process of claim 14 wherein the amount of steam is about 5 to 500 percent by weight of the bituminous hydrocarbon charged with the tar sands.

16. The process of claim 10 wherein the hot vaporized mixture of distillate and steam recovered from the heating zone is used indirectly to preheat water for use in generating steam used in the heating zone.

17. The process of claim 10 wherein the mixture formed during step (c) contains about 35 to 65 percent by weight tar sands, about 35 to 65 percent by weight water, and about 5 to 15 percent by weight solvent and the mixing temperature is about 70° F. to about 100° F.

18. The process of claim 10 wherein the end boiling point of the hydrocarbon distillate recovered from the heating step (a) is within the range of about 500° F. to about 800° F.

19. The process of claim 10 wherein at least a part of the heat energy required for the heating zone is generated by heat exchange with hot sand particles or gaseous and vaporous distillate recovered from the heating zone.

* * * * *